United States Patent [19]

Nelson et al.

[11] Patent Number: 4,701,268

[45] Date of Patent: Oct. 20, 1987

[54] FABRIC CONDITIONERS

[75] Inventors: Charles R. Nelson, Nr Carlisle; Hugh Thomas, Great Ayton, both of England

[73] Assignee: Imperial Chemical Industries PLC, London, England

[21] Appl. No.: 743,353

[22] Filed: Jun. 10, 1985

[30] Foreign Application Priority Data

Jun. 12, 1984 [GB] United Kingdom ..... 8414944

[51] Int. Cl.[4] ..... D06M 13/46

[52] U.S. Cl. ..... 252/8.8; 252/8.6; 252/547

[58] Field of Search ..... 252/8.8, 8.6, 547; 560/252, 253

[56] References Cited

U.S. PATENT DOCUMENTS

| | | | |
|---|---|---|---|
| 4,128,485 | 12/1978 | Bauman et al. | 252/8.8 |
| 4,214,998 | 7/1980 | Joy | 252/8.8 |
| 4,339,391 | 7/1982 | Hoffmann et al. | 206/401 |
| 4,368,127 | 1/1983 | Richmond | 252/8.8 |
| 4,399,043 | 8/1983 | Keil et al. | 252/8.7 |
| 4,464,272 | 8/1984 | Parslow et al. | 252/8.8 |
| 4,497,716 | 2/1985 | Tai | 252/8.8 |

FOREIGN PATENT DOCUMENTS 0022562 6/1985 European Pat. Off. .

*Primary Examiner*—Paul Lieberman
*Assistant Examiner*—Lynda D. Skaling
*Attorney, Agent, or Firm*—Cushman, Darby & Cushman

[57] ABSTRACT

A fabric softening composition of high active component content consists of a blend of an alkoxylated organic amide derivative (A) and a quaternary ammonium compound (B), the weight ratio of (A) to (B) in the composition being in the range 90:10 to 40:60. Component A comprises a derivative of general formula:

where $R_1$ comprises a long chain alkyl group containing 8 to 24, preferably 12 to 20, more preferably 13 to 17 carbon atoms;

$R_2$ and $R_3$, which may be the same or different, comprise hydrogen or an alkyl group containing 1 to 10, preferably 1 to 6, carbon atoms and more preferably are both methyl;

$R_4$ comprises a long chain alkyl group containing 8 to 24, preferably 11 to 21, more preferably 15 to 17 carbon atoms;

AO comprises an alkylene oxide or mixed alkylene oxide, for example ethylene oxide, propylene oxide, and n is in the range 1 to to 10, preferably in the range 1 to 6 and more preferably is 1; and X is an anion.

Component B comprises a compound of general formula:

where $R_1$ and $R_2$ which may be the same or different are long chain alkyl group containing 8 to 24 carbon atoms, preferably 12 to 20 carbon atoms;

$R_3$ and $R_4$ which may be the same or different are short chain alkyl groups containing 1 to 6 carbon atoms, preferably methyl; and A is an anion.

7 Claims, 6 Drawing Figures

FABRIC CONDITIONERS

The present invention relates to improved fabric conditioning compositions.

Fabric conditioning is normally achieved by one of the following techniques viz (a) the use of a combined detergent/conditioner/-composition in the wash cycle which both cleans and conditions at the same time (in the past few years several proposals have been made in this area involving the use of nonionic and/or anionic surfactants in combination with cationic surfactants);

(b) the addition of an inert substrate impregnated with a fabric conditioning agent to the hot air dryer. The temperature within the drier is such that the fabric conditioning agent is melted and then diffuses on to the fabric surface as a result of agitation within the drier; and (c) the addition of a fabric conditioning agent to the cold water rinse sequence of the normal wash cycle.

Commercial fabric conditioner formulations used in the cold water rinse are normally based on a difatty dimethyl quaternary ammonium salt, for example dihydrogenated tallow dimethyl quaternary ammonium chloride (DHTDMQC), distearyl dimethyl quaternary ammonium methosulphate etc at a 6 to 8% total active level, the balance comprising water and various minor components. Although these formulations convey a satisfactory soft feel to treated fabric there are a number of disadvantages associated with the DHTDMQC type of fabric conditioner active component. DHTDMQC is sold at at least a 75% active level in a mixed solvent system. It is a paste at normal ambient temperatures and therefore requires heated storage. Manufacturers of fabric conditioner formulations also experience difficulty in preparing storage-stable aqueous dispersions of DHTDMQC especially under freeze-thaw conditions. Although the difficulty can be overcome at low active levels, for example 6% w/w, using a combination of high shear mixing and electrolytes both the water and DHTDMQC have to be warmed to temperatures in excess of 50° C. before mixing.

For various reasons it is desirable to increase the active level in fabric conditioners from the normal range of about 6 to 8%. For the manufacturer higher active levels would have economic advantages in savings on transport costs and in savings on packaging. There would also be advantage for the retail customer in that smaller containers which would be easier to use could be employed.

Formulations containing DHTDMQC at active levels above 10% w/w tend to be very viscous. Repeated use of fabric conditioner formulations based on DHTDMQC also leads to a build-up in the hydrophobic nature of treated fabric. This hydrophobicity gives the fabric a "greasy" feel and interferes with the absorption of moisture. The latter effect is a significant disadvantage for towels, babies' nappies etc.

Various proposals have been made in an effort to overcome the difficulties associated with formulations based on DHTDMQC although even these have some drawbacks. Several such proposals involve the preparation of so-called "triple-active" softeners (ie containing ca 3 to 16% total active matter) by including 1 to 5% of a non-ionic surfactant (for example an amine ethoxylate or an alcohol ethoxylate) as part of the active matter but, since these are poorer softeners than DHTDMQC, the effective softening power of these formulations when added to the wash is relatively less than that of the so-called "low-active" softeners (ie those containing ca 4 to 6% DHTDMQC). Another proposal has been to prepare the cationic softener feedstock in water and then homogenise it at a pressure of 16 to 40 $N/mm^2$. This produces stable, low viscosity dispersions but after homogenisation the dispersions must be rapidly cooled which means that the method involves high costs in terms of apparatus and energy. In addition, the inorganic salt content must be kept to a minimum because otherwise the dispersions tend to separate. Deionised water must therefore be used.

There is a need, therefore, for fabric conditioner compositions which have a high active level but which are easier to formulate at active levels above about 10% w/w and which, at the same time, are liquid and not too viscous at ambient temperatures. It is also desirable that the conditioner should have adequate re-wet characteristics, that is that its water repellency when on the fabric should not be so great that there is a build-up in the hydrophobic nature of the treated fabric. It is also desirable that the conditioner should be storage-stable, i.e. that it should not separate into two or more phases, including when it is subjected to more stringent low temperature storage (usually known as freeze-thaw conditions), and that its viscosity should not increase to an unacceptable level even over a period of several months.

We have now surprisingly found that it is possible to prepare a fabric conditioning composition of high active content and having long-term storage stability together with good softening, anti-static and rewettability properties.

Accordingly, the present invention comprises a fabric conditioning composition wherein the active system comprises a blend of at least two components A and B, as hereinafter defined. Component A comprises an organic amine derivative having the general formula

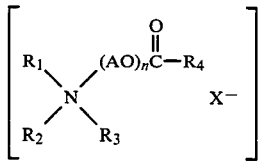

where $R_1$ comprises a long chain alkyl group containing 8 to 24, preferably 12 to 20, more preferably 13 to 17 carbon atoms $R_2$ and $R_3$, which may be the same or different, comprise hydrogen or an alkyl group containing 1 to 10, preferably 1 to 6, carbon atoms and more preferably are both methyl;

$R_4$ comprises a long chain alkyl group containing 8 to 24, preferably 11 to 21, more preferably 15 to 17 carbon atoms;

AO comprises an alkylene oxide or mixed alkylene oxide, for example ethylene oxide, propylene oxide, and n is in the range 1 to 10, preferably in the range 1 to 6 and more preferably is 1; and X is an anion.

In more preferred embodiments of this invention, in component A the substituent $R_1$ comprises a long chain alkyl group or mixtures thereof containing 13 to 15 carbon atoms, the groups being both straight chain and branched, the amount of branching being in the range 30 to 70%.

In more preferred embodiments of this invention, component A is a mixture of compounds in which the substituent $R_1$ is a long chain alkyl group containing 13 to 15 carbon atoms comprising approximately 65 to 75% $C_{13}$ groups with approximately 35 to 25% $C_{15}$ groups (the percentage being calculated on the total of long chain alkyl groups) with approximately 40 to 55% w/w straight chain to 60 to 45% 2-alkyl branched chain where the 2-alkyl groups are predominantly methyl. Particularly suitable for use as Component A is the composition "Synprolam" FS ("Synprolam" is a Registered Trade Mark) which has a composition conforming substantially to the more preferred embodiment hereinbefore defined.

Component B comprises a quaternary ammonium compound of general formula:

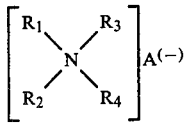

where $R_1$ and $R_2$ which may be the same or different are long chain alkyl groups containing 8 to 24 carbon atoms, preferably 12 to 20 carbon atoms;

$R_3$ and $R_4$ which may be the same or different are short chain alkyl groups containing 1 to 6 carbon atoms, preferably methyl; and A is an anion.

Preferably, component B comprises dihydrogenated tallow dimethylammonium chloride, for example, the composition known as "Arquad" 2HT.

The weight ratio of component A to component B (ignoring any other constituents of the fabric conditioning composition) is in the range 90:10 to 40:60, preferably in the range 80:20 to 50:50, more preferably in the range 75:25 to 50:50.

Preferably the compositions according to this invention contain at least 10% by weight in total of components A and B.

The compositions of this invention are prepared by mixing components A and B, together with any other desired constituents such as minor amounts of dyes and perfumes, in water which preferably is warm. However, in contrast to prior art compositions, the compositions of this invention can be prepared at relatively low temperatures which do not need to exceed 50° C.

BRIEF DESCRIPTION OF THE DRAWINGS

FIG. 4 illustrates storage stability at ambient temperature, whereas FIGS. 5 and 6 illustrate storage stability under freeze-thaw and elevated temperature regimes respectively.

Figure 1:
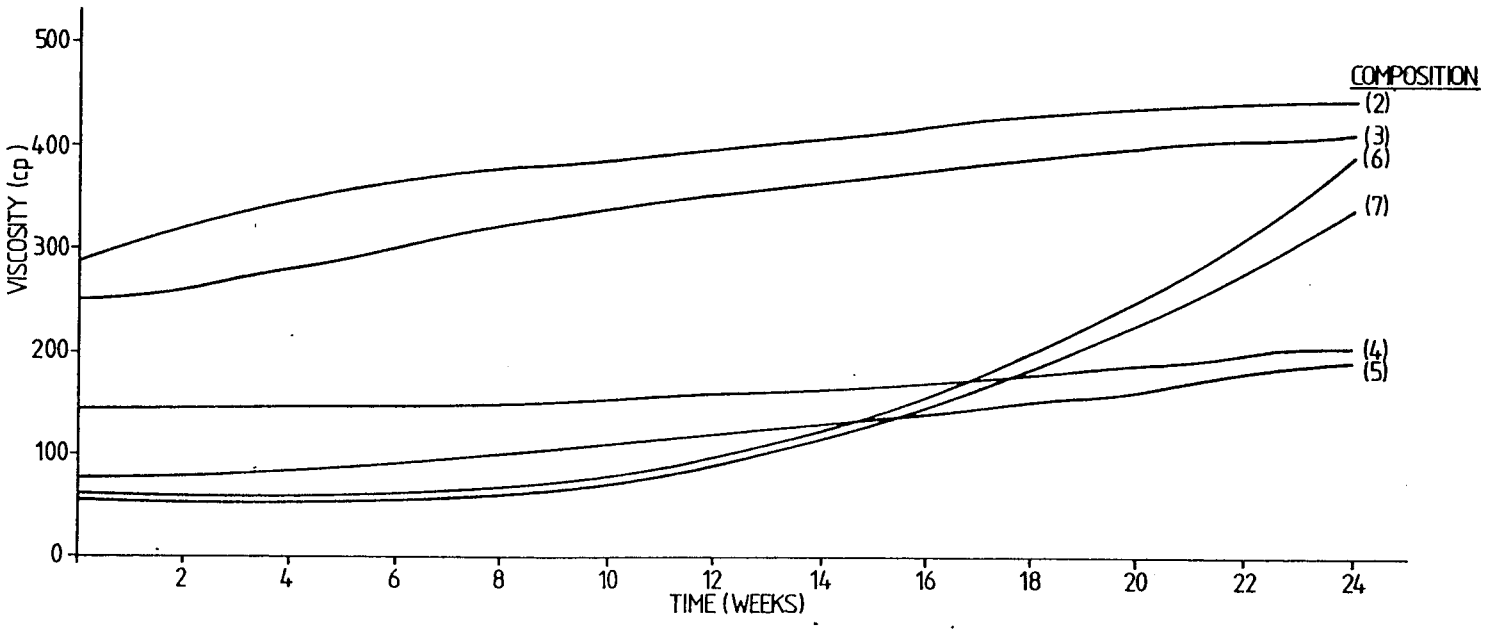
FIG. 1 illustrates the storage stability at ambient temperature of three compositions according to the invention and three comparative compositions.

The compositions of the present invention are further illustrated in the following Examples

EXAMPLE 1

Several fabric conditioning compositions were prepared, containing a total of 15% active components. The active components used were the product known as "Synprolam" FS (Component A) and the product known as "Arquad" 2HT (Component B) which is a 75% solution in isopropanol/water of dihydrogenated tallow dimethylammonium chloride.

The compositions were prepared by blending components A and B in the appropriate ratios at 40° C. and adding the mixture to water (containing 0.3% w/w calcium chloride) at 40° C. Stirring was carried out with a propeller blade stirrer at 400 r.p.m. Details of the compositions prepared are given in Table 1.

TABLE 1

| Composition No | Component A Wt % | Component B Wt % | Wt Ratio A:B |
|---|---|---|---|
| 1 | 0 | 15 | 0:100 |
| 2 | 3.75 | 11.25 | 25:75 |
| 3 | 5 | 10 | 34:66 |
| 4 | 7.5 | 7.5 | 50:50 |
| 5 | 11.25 | 3.75 | 75:25 |
| 6 | 13.5 | 1.5 | 90:10 |
| 7 | 15 | 0 | 100:0 |

The storage stability of these compositions was studied under three temperature regimes:

1. Ambient temperature: 20° to 25° C. continuously for 6 months.
2. Freeze-thaw: −5° to 0° C. overnight; 20° to 25° C. daytime for 1 month
3. Elevated temperature: 40° C. overnight; 20° to 25° C. daytime for 1 month Viscosity changes during the period of the tests were measured using a Brookfield viscometer (model RVT) spindle No. 2 and a spindle speed of 100 rpm. The results are tabulated in Table 2 and are presented graphically in FIGS. 1 to 3 respectively for the three temperature regimes. The figures in Table 2 refer to viscosities in centipoise.

TABLE 2

| FIG. | Composition | Initial | 1 week | 2 weeks | 4 weeks | 8 weeks | 16 weeks | 24 weeks |
|---|---|---|---|---|---|---|---|---|
| 1 | 2 | 286 | 314 | 318 | 326 | 374 | 354 | 442 |
| | 3 | 304 | 262 | 252 | 270 | 339 | 346 | 412 |
| | 4 | 145 | 144 | 142 | 142 | 168 | 158 | 206 |
| | 5 | 78 | 76 | 81 | 90 | 102 | 138 | 190 |
| | 6 | 61 | 60 | 60 | 60 | 69 | 154 | 388 |
| | 7 | 54 | 50 | 52 | 52 | 58 | 150 | 330 |
| 2 | 2 | 286 | 414 | 510 | 680 | | | |

TABLE 2-continued

| FIG. | Composition | Initial | 1 week | 2 weeks | 4 weeks | 8 weeks | 16 weeks | 24 weeks |
|---|---|---|---|---|---|---|---|---|
| | 3 | 304 | 306 | 402 | 462 | | | |
| | 4 | 145 | 158 | 189 | 228 | | | |
| | 5 | 78 | 56 | 57 | 60 | | | |
| | 6 | 61 | 44 | 42 | 44 | | | |
| | 7 | 54 | 42 | 40 | 40 | | | |
| 3 | 2 | 286 | 330 | 440 | 668 | | | |
| | 3 | 304 | 300 | 360 | 374 | | | |
| | 4 | 145 | 212 | 288 | 248 | | | |
| | 5 | 78 | 120 | 170 | 140 | | | |
| | 6 | 61 | 90 | 100 | 112 | | | |
| | 7 | 54 | 65 | 72 | 62 | | | |

For reference, it should be noted that the viscosity at 25° C. of a 15% dispersion of Arquad 2HT (Component B) prepared in the above manner is ca.600 centipoise, rising to ca.3000 cp after 7 days which is totally unacceptable for domestic use. The viscosity at 25° C. of a 15% dispersion of "Synprolam" FS (Component A) is only ca 50 to 60 centipoise which makes it suitable for domestic use. "Synprolam" FS is a very good fabric softener in its own right with good freeze-thaw stability properties although its viscosity tends to rise slightly over extended periods of storage at ambient temperatures. These two components therefore have very different individual properties but most surprisingly compositions according to this invention containing both of them show excellent long term storage properties as well as retaining the very acceptable fabric softening properties of the individual components. Their viscosities show only very slight rises initially. Thereafter the viscosity remains substantially unchanged in compositions such as that with A:B=75:25 or A:B=50:50. This means that it is now possible to prepare high active formulations which are stable over very long periods.

Referring to the Figures, FIG. 1 illustrates the storage stability at ambient temperature of three compositions (4,5 and 6) according to this invention and three other compositions (2,3,7) for comparative purposes which are not according to the invention. As hereinbefore mentioned, the viscosity of a composition consisting solely of Arquad 2HT is very high, being very much higher than any of those shown in FIG. 1. In contrast, the viscosity of "Synprolam" FS (composition 7) is initially low but steadily rises to about 350 cp after 25 weeks. The viscosity of composition 3 is initially high, increases over a few weeks and then remains substantially steady at about 600 cp.

In marked contrast the compositions 4, 5 according to the invention, even including composition 4 which has 50% of each component, are all of relatively low viscosity and show no signs of storage instability, even after 24 weeks. Composition 6, which with a component A: component B ratio of 90:10 is only just according to the invention shows rather poor performance. However, attention is drawn to the rather similar composition 10, illustrated hereinafter in Example 2, which shows very good performance. It appears that these 90:10 compositions can show variable performance.

Figure 2:
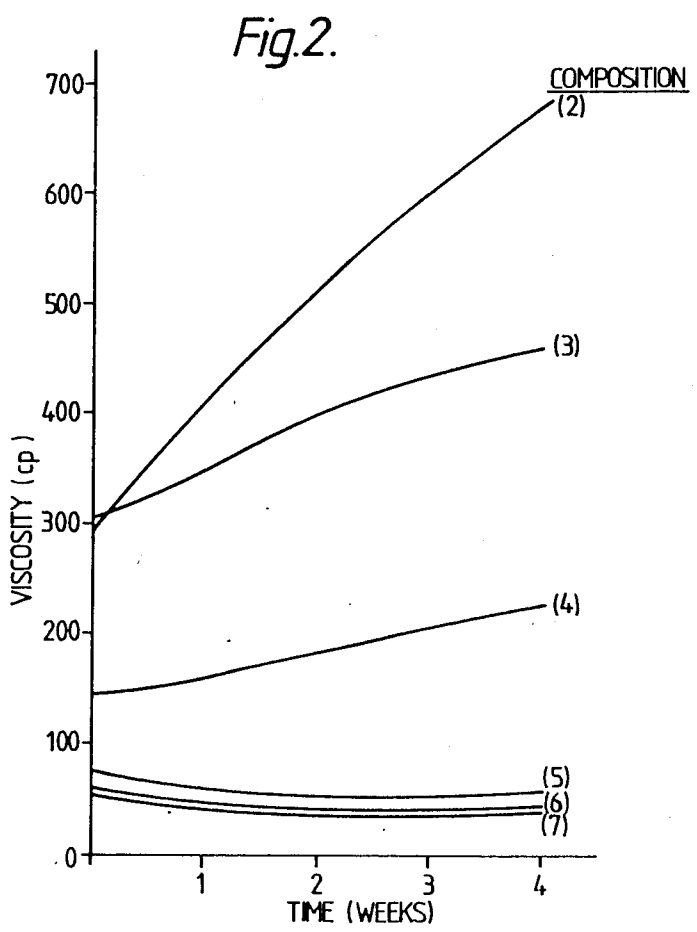
FIG. 2 illustrates the freeze-thaw stability of the same compositions illustrated in FIG. 1.

FIG. 2 illustrates the freeze-thaw stability of the same compositions illustrated in FIG. 1. Once again, the viscosity of Arquad 2HT alone is much higher than any of the other compositions, rising to a very high value indeed after 7 days (not shown in the Figure). FIG. 2 illustrates the excellent freeze-thaw stability of "Synprolam" FS alone and the surprising stability of compositions containing substantial amounts of both it and Arquad 2HT. (See, for example, compositions 4,5 and 6). However, compositions 2 and 3 which are not according to the invention, illustrate how the viscosity increases over a few weeks in compositions containing relatively small amounts of "Synprolam" FS.

Figure 3:
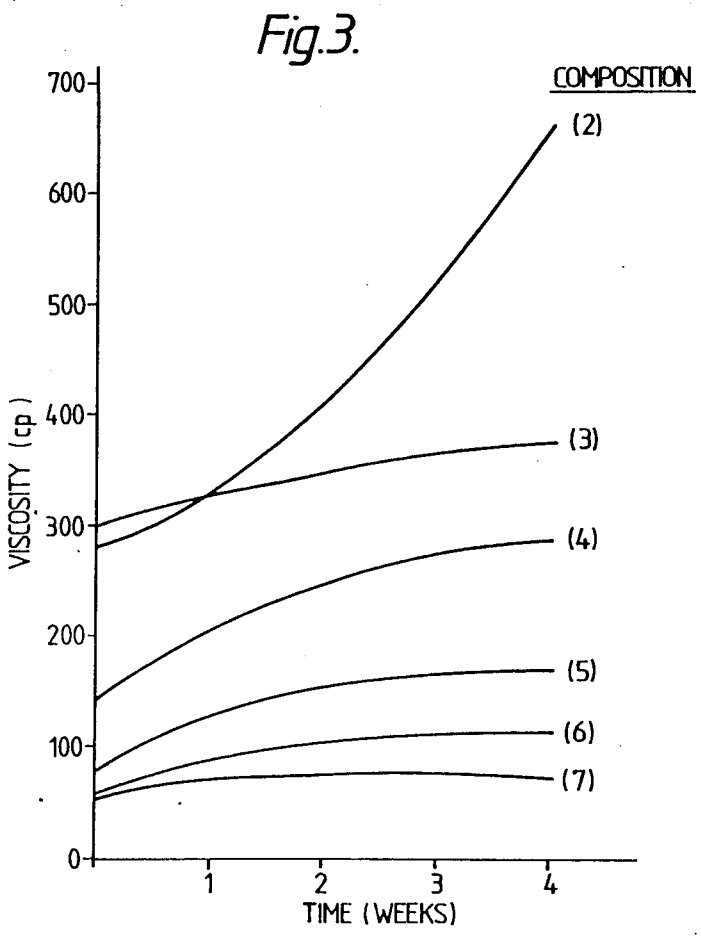
FIG. 3 illustrates the storage stability at elevated temperatures of the same compositions used for FIGS. 1 and 2.

FIG. 3 illustrates the storage stability at elevated temperature of the same compositions used for FIGS. 1 and 2. Again, the excellent storage-stability of "Synprolam" FS alone (curve 7) is shown. Once again, curves 4, 5, and 6 illustrate the excellent storage stability of compositions according to this invention.

EXAMPLE 2

Several fabric conditioning compositions were prepared containing not only components A and B (of the same composition as in Example 1) but also perfume and dye. The level of calcium chloride in these formulations was also carefully adjusted so as to control their initial viscosity within the range 50 to 80 cp. The formulations were therefore prepared by blending components A and B in the appropriate ratios at 40° C. and adding the mixture to water (containing 0.3% w/w calcium chloride) at 40° C. Stirring was with a propeller blade stirrer at 400 r.p.m. Dye (0.003% w/w) and perfume (0.45% w/w) were then added and a further small addition of calcium chloride ("post-addition") made where necessary to control viscosity. The formulations of this example can therefore be regarded as more akin to "finished" formulations than the formulations prepared in Example 1.

Details of the compositions prepared in this example are given in Table 3.

TABLE 3

| Composition No | Component A wt % | Component B wt % | Wt ratio A:B | Calcium Chloride Post-addition wt % |
|---|---|---|---|---|
| 8 | 7.5 | 7.5 | 50:50 | 0.075 |
| 9 | 11.25 | 3.75 | 75:25 | 0.050 |
| 10 | 13.25 | 1.5 | 90:10 | 0 |
| 11 | 15 | 0 | 100:0 | 0 |

The storage stability of these compositions was studied in the same way and under the same three temperature regimes as for the compositions of Example 1. The results are tabulated in Table 4, where the figures refer to viscosities in centipoise, and are presented graphically in FIG. 4 (ambient temperature), FIG. 5 (Freeze-thaw) and FIG. 6 (Elevated temperature).

TABLE 4

| FIG. | Composition | Initial | 1 week | 2 weeks | 4 weeks | 8 weeks | 16 weeks | 24 weeks |
|---|---|---|---|---|---|---|---|---|
| 4 | 8 | 63 | 60 | 58 | 62 | 69 | 80 | 100 |

TABLE 4-continued

| FIG. | Composition | Initial | 1 week | 2 weeks | 4 weeks | 8 weeks | 16 weeks | 24 weeks |
|---|---|---|---|---|---|---|---|---|
| | 9 | 60 | 60 | 52 | 60 | 73 | 80 | 132 |
| | 10 | 62 | 58 | 62 | 68 | 70 | 132 | 186 |
| | 11 | 61 | 54 | 54 | 58 | 68 | 122 | 370 |
| 5 | 8 | 63 | 56 | 71 | 76 | | | |
| | 9 | 60 | 46 | 50 | 52 | | | |
| | 10 | 62 | 42 | 49 | 42 | | | |
| | 11 | 61 | 40 | 48 | 40 | | | |
| 6 | 8 | 63 | 126 | 180 | 280 | | | |
| | 9 | 60 | 168 | 317 | 330 | | | |
| | 10 | 62 | 100 | 208 | 266 | | | |
| | 11 | 61 | 98 | 126 | 146 | | | |

Figure 4:
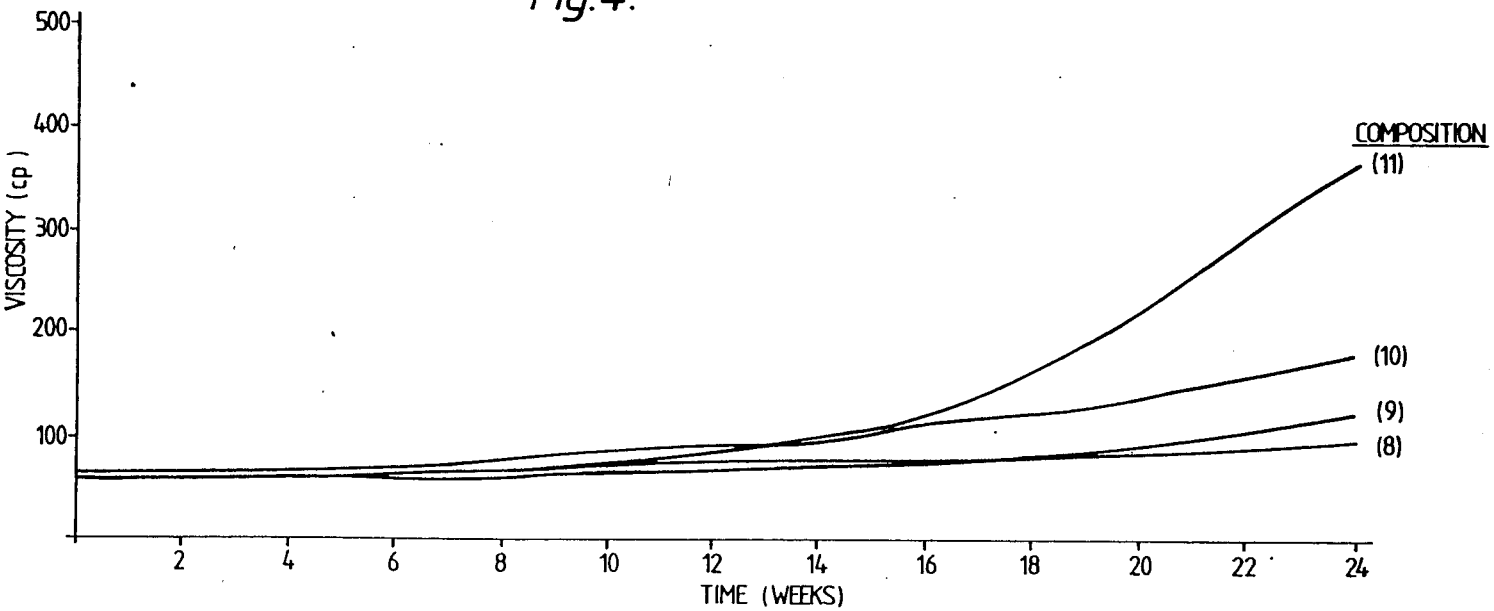
FIGS. 4, 5, and 6 illustrate the storage stability of another three compositions according to the invention and one comparative composition.

Referring to the Figures, FIG. 4 shows that compositions 8 to 10, which are all according to the invention, are all of relatively low viscosity and show no sign of storage instability after 24 weeks. In contrast, the performance of composition 11 is poor.

Figure 6:
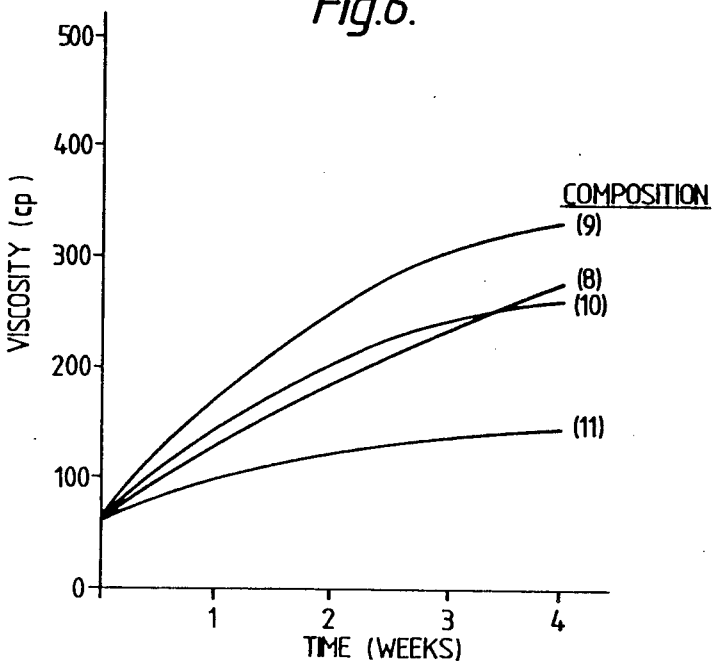
Figure 5:
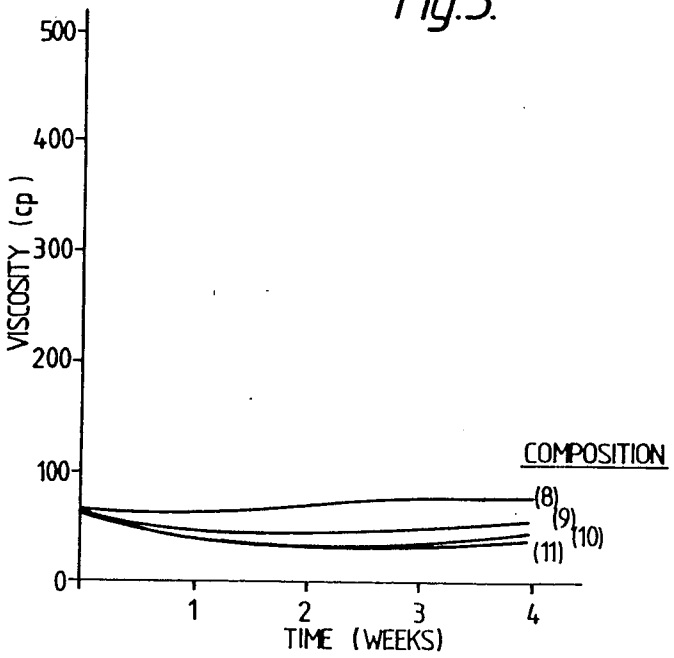

FIG. 5 shows that all four formulations show excellent stability in the freeze-thaw test and FIG. 6 shows that all formulations show good storage stability, even at elevated temperature.

We claim:

1. A fabric softening composition wherein the active system consists essentially of a blend of at least 10% by weight of at least two components A and B wherein:

(A) Component A comprises an organic amine derivative having general formula

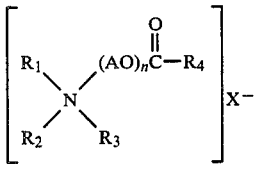

where $R_1$ comprises a long chain alkyl group containing 8 to 24 carbon atoms;

$R_2$ and $R_3$, which may be the same or different, comprise hydrogen or an alkyl group containing 1 to 10 carbon atoms;

$R_4$ comprises a long chain alkyl group containing 8 to 24 carbon atoms;

AO comprises an alkylene oxide or mixed alkylene oxide, and n is in the range 1 to 10; and X is an anion;

and (B) Component B comprises a quaternary ammonium compound of general formula:

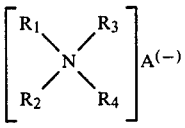

where $R_1$ and $R_2$ which may be the same or different are long chain alkyl groups containing 8 to 24 carbon atoms;

$R_3$ and $R_4$ which may be the same or different are short chain alkyl groups containing 1 to 6 carbon atoms; and A is an anion;

and wherein the weight ratio of component A to component B (ignoring any other constituents of the fabric softening composition) is in the range 90:10 to 40:60.

2. A composition as claimed in claim 1 wherein in component A the substituent $R^1$ comprises a long chain alkyl group or mixtures thereof containing 13 to 15 carbon atoms, the groups being both straight chain and branched, the amount of branching being in the range 30 to 70%.

3. A composition as claimed in claim 1 wherein component A comprises a mixture of compounds in which the substituent $R_1$ is a long chain alkyl group containing 13 or 15 carbon atoms comprising approximately 65 to 75% $C_{13}$ groups with approximately 35 to 25% $C_{15}$ groups (the percentage being calculated on the total of long chain alkyl groups) with approximately 40 to 55% w/w straight chain to 60 to 45% 2-alkyl branched chain where the 2-alkyl groups are predominantly methyl.

4. A composition as claimed in claim 1 wherein component B comprises dihydrogenated tallow dimethylammonium chloride.

5. A composition as claimed in claim 3 wherein component B comprises dihydrogenated follow dimethylammonium chloride.

6. A composition as claimed in claim 1 wherein the weight ratio of component A to component B (ignoring other constituents of the composition) is in the range 80:20 to 50:50.

7. A process of fabric softening which comprises contacting a fabric with a softening composition as claimed in claim 1.

* * * * *